United States Patent [19]

Chrisp

[11] 4,008,108

[45] Feb. 15, 1977

[54] FORMATION OF FOAMED EMULSION-TYPE BLASTING AGENTS

[75] Inventor: Joseph Dean Chrisp, Hagerstown, Md.

[73] Assignee: E. I. Du Pont de Nemours and Company, Wilmington, Del.

[22] Filed: Apr. 22, 1975

[21] Appl. No.: 570,952

[52] U.S. Cl. ..... 149/2; 149/44; 149/60; 149/109.6

[51] Int. Cl.[2] ..... C06B 45/00; C06B 33/02; C06B 31/30; C06B 43/00

[58] Field of Search ..... 149/109.6, 2, 44, 45, 149/60

[56] References Cited

UNITED STATES PATENTS

| | | | |
|---|---|---|---|
| 2,768,072 | 10/1956 | Stark | 149/109.6 |
| 3,288,658 | 11/1966 | Ferguson | 149/41 |
| 3,288,661 | 11/1966 | Swisstack | 149/41 |
| 3,678,140 | 7/1972 | Adams | 149/109.6 |
| 3,706,607 | 12/1972 | Chrisp | 149/44 |
| 3,711,345 | 1/1973 | Tomic | 149/44 |
| 3,713,919 | 1/1973 | Tomic | 149/47 |
| 3,770,522 | 11/1973 | Tomic | 149/44 |
| 3,783,053 | 1/1974 | Oettmeier | 149/44 |
| 3,790,415 | 2/1974 | Tomic | 149/44 |
| 3,886,010 | 5/1975 | Thornley | 149/44 |

*Primary Examiner*—Samuel W. Engle
*Assistant Examiner*—Donald P. Walsh

[57] ABSTRACT

In the chemical foaming of emulsions to form blasting agents, the gas-generating material (foaming agent), or a component thereof, is introduced into a stream of the emulsion and the stream thereafter delivered into packaging receivers, any work required to be performed on the emulsion after the addition of the gas-generating material thereto, e.g., pumping or mixing, being performed before substantial foaming due to reaction of the gas-generating material, as a rule before more than about 50 percent of the total density decrease attainable by foaming, has occurred. The gas-generating material can be added to a stream of fine emulsion and preferably mixed for uniform distribution through the emulsion, or to a stream of coarse emulsion, which is mixed with high shear to convert the coarse emulsion to a fine emulsion, mixing in either case taking place before substantial foaming has occurred.

25 Claims, 1 Drawing Figure

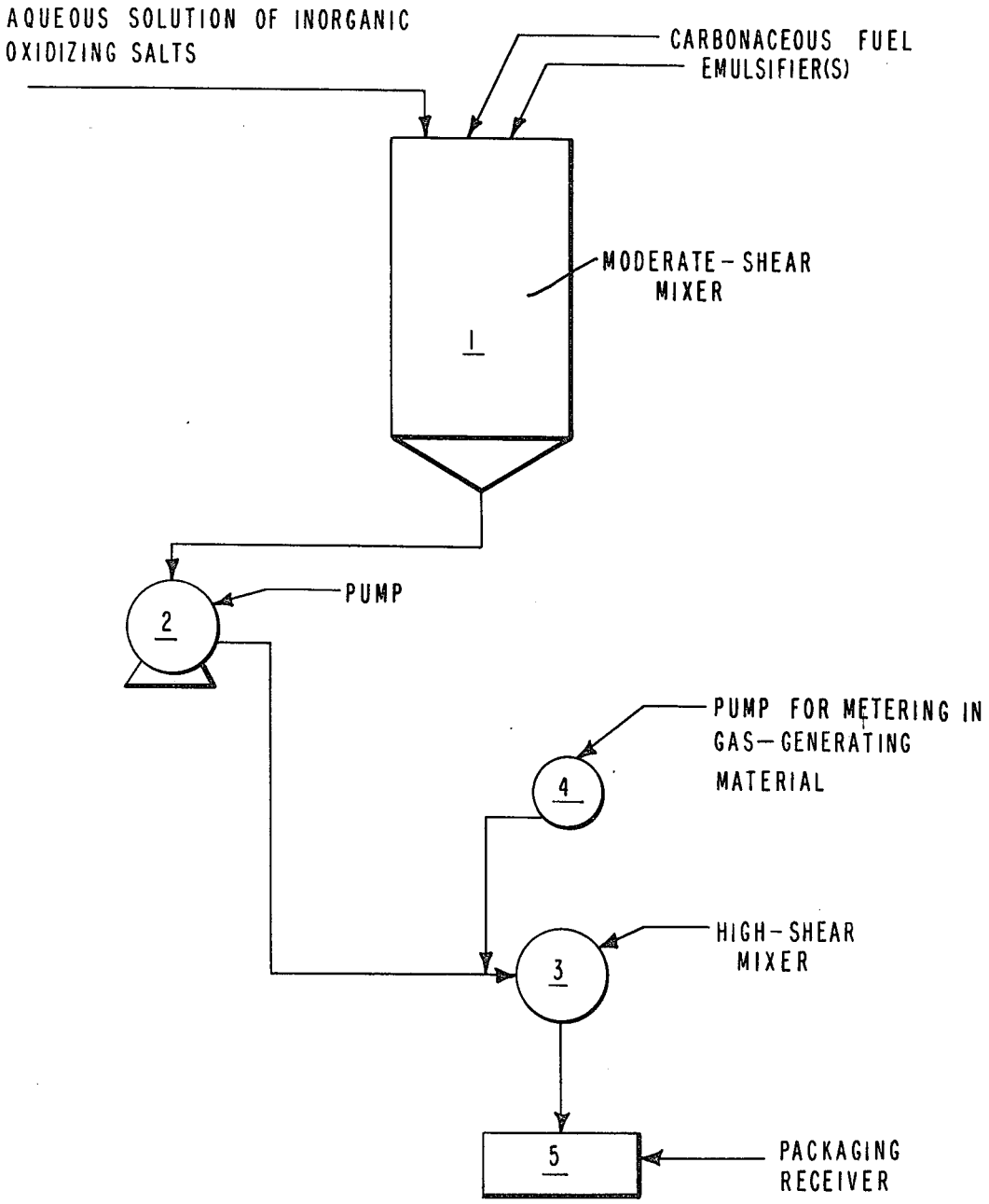
AQUEOUS SOLUTION OF INORGANIC OXIDIZING SALTS
CARBONACEOUS FUEL
EMULSIFIER(S)
MODERATE-SHEAR MIXER
1
PUMP
2
PUMP FOR METERING IN GAS-GENERATING MATERIAL
4
HIGH-SHEAR MIXER
3
5
PACKAGING RECEIVER

FORMATION OF FOAMED EMULSION-TYPE BLASTING AGENTS

BACKGROUND OF THE INVENTION

1. Field of the Invention

The present invention relates to the formation of emulsion blasting agents by the chemical foaming of emulsions comprising inorganic oxidizing salt, carbonaceous fuel, water, and emulsifier to decrease their density and thereby increase their sensitivity to initiation.

2. Description of the Prior Art

Emulsion-type semisolid colloidal dispersions of water-bearing blasting agents are prepared by mixing an inorganic oxidizing salt, a liquid carbonaceous fuel, an emulsifying agent (at least one of each of these components), and water, and commonly are sensitized by incorporating small gas bubbles or gas-entrapping material into the mix. The incorporation of gas bubbles by the in situ chemical generation of gas in the emulsion as a result of the decomposition of a foaming agent therein is described, for example, in U.S. Pat. Nos. 3,706,607, 3,711,345, 3,713,919, 3,770,522, and 3,790,415. As described in the art, the foaming agent is added to the mixture of the other ingredients after the emulsion has formed so that the composition is sufficiently viscous to retain gas bubbles when foaming occurs.

Emulsion-type blasting agents for use in small or intermediate diameters, e.g., about 1- to 4-inch diameters, are conveniently packaged in the form of "chubs" on highspeed continuous cartridging machines which form tubes of plastic film, fill the tubes with blasting agent, and mechanically close each end of the filled cartridge. For practical reasons, the emulsion is delivered to the packaging equipment by pumping. However, pumping, as well as other procedures which work the emulsion, e.g., mixing, such procedures deviating the course of flow of the stream, for example by a shearing action, pose problems in the case of foamed emulsion blasting agents owing to the fact that an increase in the density of the emulsion may occur as a result of the escape of gas therefrom caused by such procedures, thereby deleteriously affecting the sensitivity of the emulsion to initiation.

Procedures also have been described in the art for chemically foaming the type of blasting agents known as water gels or slurry explosives, these blasting agents containing a thickener to provide the required consistency. U.S. Pat. NO. 3,288,658, for example, describes generating carbon dioxide in a sensitized slurry explosive to regulate explosive strength, by the in situ reaction of a water-soluble carbonate and an acid. This patent shows discharging a mixture of water, oxidizer salt, sensitizer, guar gum (thickener), and acetic acid (a component of the gas-generating material) from a first mixing chamber, and a sodium bicarbonate (gas-liberating salt) and crosslinkable guar gum mixture from a second mixing chamber into the discharge stream from the first. Crosslinking of the guar gum takes place, resulting in an increased consistency of the mix to facilitate entrainment of the carbon dioxide liberated by the bicarbonate/acid reaction. This patent does not describe the effect of pumping on the foamed water gel, and more particularly makes no suggestion that pumping of the described water gel after substantial foaming thereof can be deleterious; nor is mixing of the water gel after the addition of the gas-generating material described.

SUMMARY OF THE INVENTION

The present invention provides an improved method of chemically foaming an emulsion comprised of inorganic oxidizing salt, carbonaceous fuel, water, and emulsifier to form a blasting agent, the method comprising continuously injecting a gas-generating material, e.g., N,N′-dinitrosopentamethylenetetramine, or one or both components of a dual-component gas-generating material, e.g., potassium permanganate and hydrogen peroxide, into a stream of the emulsion and thereafter delivering the injected stream of emulsion into one or more packaging receivers, e.g., the film tubes formed on a chub cartridging machine, the gas-generating material reacting with gas evolution so as to foam the emulsion, and work, e.g., pumping or mixing, that is to be performed on the injected stream being performed before substantial foaming of the emulsion has occurred.

Although the degree of foaming which can be tolerated in an emulsion undergoing pumping or mixing without causing gas to escape and producing deleterious effects on the density, and consequently the sensitivity, of the emulsion depends in any given case on the density desired and on how low a density can be achieved prior to the pumping or mixing, as a rule it is best to perform the work before more than about 50 percent of the total density decrease that is attainable by full foaming has been reached.

"Work" as used herein with reference to an action exerted on the stream of emulsion containing the gas generating material denotes a mechanical operation which rapidly and repeatedly, e.g., turbulently, deviates the flow of the emulsion stream, e.g., by shearing action, and includes various types of pumping procedures, mixing procedures, and the like.

The emulsion stream can be pumped from a continuous or batch-type mixing apparatus directly into the packaging receivers, or indirectly through a second mixing apparatus, which disperses the gas-generating material in the emulsion and may also increase the viscosity of the emulsion prior to entry into the receivers. The gas-generating material can be injected into the emulsion stream between the mixing apparatus and the pump which delivers the stream to the receivers or to a second mixing apparatus, or preferably downstream of said pump, most preferably just prior to or during the stream's entry into a second mixing apparatus.

BRIEF DESCRIPTION OF THE DRAWING

The attached drawing is a flow diagram of an emulsion preparation operation for carrying out one embodiment of the method of the invention.

DETAILED DESCRIPTION OF THE INVENTION

According to the present invention, the addition of a gas-generating or -releasing agent to an emulsion to cause the foaming thereof with resultant lowering of the density, and consequent sensitizing, of the emulsion is accomplished in a controlled manner so that when the incorporation of the gas-generating material is followed by an emulsion packaging operation, the desired low density of the emulsion is achieved in the packages, and the density is uniform from package to package. This density control is achieved by adding the gas-generating material to a stream of the emulsion (as contrasted to a large volume in a vessel), and performing any necessary pumping or mixing operations on the stream before substantial foaming of the emulsion has occurred as a result of gas evolution by the reaction of the gas-generating material. It has been found that a breakdown of the foamed structure of the emulsion and an attendant increase in density are avoided if any work that rapidly and repeatedly deviates the flow of the emulsion stream, e.g., shearing action, so as to cause the escape of gas therefrom is carried out at such time that no more than about 50 percent, and preferably no more than about 25 percent, of the total density (measured at atmospheric pressure) decrease of the emulsion attainable by full foaming has been reached. Thus, in the present process, at the time of pumping or mixing, the emulsion is essentially unfoamed or only partially foamed. While in some cases it might be possible to perform the described work in the present process on an emulsion which is more than 50 percent foamed and to achieve a reasonably low final density provided the density before working is low enough to compensate for the increase occurring as a result of the work performed on the foamed emulsion, more than 50 percent foaming prior to the work is not preferred inasmuch as the lowest densities may not be attainable therewith. In emulsion blasting agents, densities of about 1.2 g./cc or lower are desired to make the blasting agent sensitive to initiation by a commercial No. 6 blasting cap.

In the embodiment of the present process shown in the drawing, a coarse emulsion e.g., an emulsion having a viscosity of about 12,000 centipoises at 150° F., is produced in a first, large-volume, mixer 1, which applies moderate shear forces to a blend of an aqueous solution of one or more inorganic oxidizing salts, e.g., ammonium nitrate and sodium nitrate; a carbonaceous fuel, e.g., a hydrocarbon oil; and emulsifier(s), e.g., sodium stearate and stearic acid. The outlet pipe of moderate-shear mixer 1 communicates with pump 2, which pumps the coarse emulsion out of the first mixer and delivers a stream of the coarse emulsion to a second, small-volume, mixer 3, e.g., a shear pump, which applies high shear forces to the coarse emulsion, converting it to a fine emulsion, producing, for example, at least about a 10-fold, and in many instances at least about a 100-fold, increase in viscosity, e.g., an emulsion having a viscosity of about 4,000,000 centipoises at 130° F. Pump 4 continuously meters a gas-generating material, e.g., an aqueous slurry of N,N′-dinitrosopentamethylenetetramine, into the stream of coarse emulsion just before the latter enters high-shear mixer 3. The emulsion stream charged with gas-generating material moves continuously through mixer 3, with a uniform residence time therein, for example, of about 1–5 seconds. As a consequence, substantially no reaction of the gas-generating material to produce foaming occurs prior to the entry of the coarse emulsion into mixer 3 or while it is in mixer 3. The fine emulsion is pumped, either by pump 2 or mixer 3 if the latter provides pumping as well as mixing action, into a packaging receiver 5, e.g., a tube of plastic film, wherein foaming of the emulsion takes place.

In the present process the gas-generating material is added to a stream of emulsion, as contrasted to large-volume mixer 1. If, in contrast to the present process, the gas-generating material is added to mixer 1 and pumping not delayed until the entire mix has been completely foamed, the degree of foaming of the emulsion pumped by pump 2 will vary depending on how long the emulsion has been in mixer 1 after the addition. Because of the variable residence time in mixer 1, parts of the emulsion will be more highly foamed than others, and the density of the emulsion emerging from mixer 3 will be variable owing to the variable degree of foaming of the emulsion pumped by pump 2 and mixed in mixer 3. Parts of the emulsion which have undergone substantial foaming, or an emulsion which has been allowed to foam completely in mixer 1 will experience an increase in density as a result of the pumping and mixing operations. In the embodiment of the present process shown in the drawing, in mixer 3 there is essentially no holdup of emulsion, and there is no chance for significant variations in the degree of foaming of the emulsion mixed therein to occur. Consequently, the problem of density variations is overcome.

In the above-described procedure, the gas-generating material can be introduced into the coarse emulsion stream upstream or downstream of pump 2 provided no substantial foaming of the emulsion occurs before its entry into mixer 3. Alternatively, the gas-generating material can be introduced into the emulsion stream by direct injection into mixer 3, or it can be injected into the fine emulsion stream leaving mixer 3. In all cases, since the emulsion stream leaving mixer 3 is subjected to pumping action for delivery to receiver 5, the stream is caused to reach receiver 5 before substantial foaming occurs.

It may not be necessary to use two mixers to achieve the desired emulsion viscosity, i.e., mixer 3 may not be required to increase the emulsion's viscosity. If such is the case, a fine emulsion will be formed in mixer 1 and either will be pumped directly into receiver 5, the gas-generating material being injected into the stream of fine emulsion between pump 2 and receiver 5 at a location such that no substantial foaming occurs before the emulsions' entry into receiver 5; or preferably will be pumped into mixer 3 as shown, which will blend the gas-generating material into the fine emulsion.

Alternative to the large-volume batch mixer 1 shown in the drawing, a continuous mixer can be used.

Many gas-generating materials are known in the art and can be used for foaming emulsion blasting agents in the present process provided they decompose to give off gas at temperatures at which the emulsion is stable. These include the nitrogen-releasing blowing agents such as N,N′-dinitrosopentamethylenetetramine (U.S. Pat. No. 3,713,919), N,N′-dimethyl- and N,N′-diethyl-N,N′-dinitrosoterephthalamide, benzenesulfonylhydrazide, azobisisobutyronitrile, and p-tert-butylbenzazide; as well as alkali metal borohydrides (U.S. Pat. No. 3,711,345); dual-component hydrazine systems (U.S. Pat. No. 3,706,607), e.g., hydrazine and hydrazine derivatives and an oxidizing agent therefor such as hydrogen peroxide, or a permanganate, dichromate, hypochlorite, iodate, or periodate; and dual component hydrogen peroxide systems (U.S. Pat. No. 3,790,415), i.e., hydrogen peroxide in conjunction with a compound that oxidizes or catalyzes the decomposition of hydrogen peroxide, e.g., a permanganate, dichromate, or hypochlorite, manganese dioxide, a source of manganous ion, or a source of cupric ion; and alkali metal or ammonium carbonates, bicarbonates, or nitrites, optionally in conjunction with an acid.

In dual-component gas-generating systems, the manner of addition of the components can vary. For example, in the hydrogen peroxide/potassium permanganate system, in which the permanganate is used to bring about more rapid foaming, both components can be injected into the emulsion stream at the same, or approximately the same, location, or they can be introduced at widely separated locations, with potassium permanganate preferably being injected into the emulsion stream last. For example, in the scheme shown in the drawing, potassium permanganate can be metered into the coarse emulsion stream by pump 4, and hydrogen peroxide can be added previously, e.g., in mixer 1. On the other hand, if the permanganate is added to mixer 1 in this system, longer mixing times may be required and pumping difficulties encountered owing to the reaction of the permanganate with ingredients of the emulsion. When both components of the gas-generating system are injected into the emulsion stream, they preferably are combined and injected into the emulsion stream together. This assures the required contact and reaction of the components in the emulsion.

The amount of gas-generatng material employed depends on the density desired and the specific material used, and has been described in the aforementioned patents. In the peroxide/permanganate system, large excesses of potassium permanganate, e.g., more than about twice the amount needed for rapid foaming should be avoided because of possible reactivity with other emulsion ingredients.

The inorganic oxidizing agents, carbonaceous fuels, and emulsifiers, and the amounts thereof which can be used in the present process are those which are conventionally used in emulsion blasting agents, and are described in such patents as the aforementioned U.S. Pat. Nos. 3,706,607, 3,711,345, 3,713,919, 3,770,522, and 3,790,415, the disclosures of which are incorporated herein by reference. When a hydrocarbon oil is used as the fuel in the case of systems in which a permanganate is a component of the gas-generating material, it is preferred that the oil be saturated. Otherwise, pumping may become difficult owing to a reaction between the oil and the permanganate.

Likewise, the temperature employed in the preparation of the emulsion is in the range disclosed in the art, i.e., about from 120° to 180° F. The temperature of the emulsion stream into which the gas-generating material is injected, and the temperature of the emulsion thereafter until delivery to the packaging receivers, depends on the specific gas-generating system used. Generally, a temperature in the 120°–180° F. range is satisfactory.

The following examples are illustrative of specific embodiments of the process of the invention.

EXAMPLE 1

Solid ammonium nitrate (110 pounds; 50 kilograms) and 75 pounds (34 kilograms) of sodium nitrate are added to 280 pounds (127 kilograms) of a 75% aqueous solution of ammonium nitrate, and the mixture is heated to 180° F. to dissolve the solids. The pH of the solution is adjusted to 5.0. The solution (465 pounds; 211 kilograms) is charged into a 550-pound (250 kilogram) turbine mixer 1, after which the emulsifying agents, sodium stearate (4.7 pounds; 2.1 kilograms) and stearic acid (5.3 pounds; 2.4 kilograms), are added to the 180° F. solution with mixing at 120 r.p.m. for 2 minutes. Thereafter, 25 pounds (11 kilograms) of Gulf Endurance 35 oil (a hydrocarbon distillate having a Saybolt viscosity of about 50 at 100° F.) is added, followed by another 2 minutes of mixing. Thereafter, 50 pounds (23 kilograms) of pre-formed fine emulsion of the same composition under preparation (viscosity: about 4,000,000 centipoises at 130° F.) is added to the mixer, the fine emulsion having been foamed by the reaction of "Unicel" ND therein to produce a density in the 1.18–1.23 g./cc. range. The addition of the fine emulsion decreases the time required for a coarse emulsion to form. The mixer speed is increased to 180 r.p.m. and mixing continued until a coarse emulsion (viscosity: about 12,000 centipoises at 150° F.) forms after a total mixing time of 8.5 minutes.

The coarse emulsion, which is at a temperature of 156° F., is pumped from the turbine mixer 1 to shear pump 3 by means of pump 2 at a rate of about 50 pounds (23 kilograms) per minute. Just before the coarse emulsion enters the shear pump, a slurry of 861 grams of Unicel ND (about a 42/58 mixture of N,N'-dinitrosopentamethylenetetramine and inert filler, by weight) in 3800 milliliters of water is metered into the stream of coarse emulsion at a rate of about 150 milliliters per minute. The shear pump 3 converts the coarse emulsion to a fine emulsion (viscosity: about 4,000,000 centipoises at 130° F.) and pumps the latter into polyethylene terephthalate film tubes rucked on the outlet pipe of the shear pump. The temperature of the fine emulsion is about 165–170° F. Because only a few seconds have elapsed between the injection of the gas-generating material into a given unit volume of coarse emulsion stream and the arrival of the same volume in the package, the emulsion mixed and pumped by the shear pump is essentially unfoamed.

After 30 minutes, as a result of foaming in the packages, the density of the emulsion in 27 sampled packages is 1.18–1.23 g./cc., with 23 out of the 27 in the 1.19–1.22 g./cc. range. After this time, the film tubes are tied closed to form cartridges, and the cartridges are ready for use.

When two of the cartridges, 16 inches (41 cm.) in length and 2.5 inches (6.4 cm.) in diameter, are butted end-to-end and one of the cartridges is initiated in air with an HDP-3 primer (described in Blasters' Handbook, 15th Ed., 1966, E. I. du Pont de Nemours and Company, page 67), the other cartridge detonates at a velocity in the range of 3800 to 5600 meters per second.

EXAMPLE 2

The procedure described in Example 1 is repeated with the exception that Unicel 100 is substituted for the Unicel ND. Unicel 100 is about 99% N,N'-dinitrosopentamethylenetetramine. The Unicel slurry consists of 390 grams of Unicel 100 in 4300 milliliters of water. Substantially the same results are obtained, the densities in 27 packages in this case being 1.18–1.24 g./cc., with 23 out of the 27 in the 1.18–1.21 g./cc. range. The detonation velocities are in the 4800–5200 meters per second range.

EXAMPLE 3

The procedure described in Example 1 is repeated with the following exceptions:

The turbine mixer has a 200-pound (91 kilogram) capacity, and the weight of the ammonium nitrate solution is 169.6 pounds (77 kilograms) (101 pounds (46 kilograms) of the 75% aqueous ammonium nitrate solution, 41.4 pounds (18.8 kilograms) of solid ammonium nitrate, and 27.2 pounds (12.3 kilograms) of sodium nitrate). The amount of sodium stearate added is 1.72 pounds (0.78 kilogram), and that of stearic acid 1.94 pounds (0.88 kilogram). After the addition of the oil (9 pounds; 4 kilograms), 120 milliliters of 30–35% aqueous hydrogen peroxide is added. The amount of preformed fine emulsion added is 20 pounds (9 kilograms). The coarse emulsion forms at 158° F. after a total mixing time of 6.5 minutes. Instead of Unicel ND, a 5% (by weight) aqueous solution of potassium permanganate is metered into the coarse emulsion stream at a rate of 170 milliliters per minute. The density after foaming is 1.10–1.12 g./cc. Substituting a No. 6 blasting cap for the HDP-3 primer, the detonation velocity is 5200 m./sec.

EXAMPLE 4

When the procedure described in Example 3 is repeated except that one-half the amount of peroxide solution and one-half the concentration of permanganate solution are used, the coarse emulsion forms at 164° F. in 7 minutes. The densities after foaming are 1.22–1.24 g./cc. The detonation velocities are 5400–5600 m./sec.

CONTROL EXPERIMENT

When the procedure described in Example 1 is repeated with the exception that the Unicel ND (570 grams) is added to the turbine mixer instead of to the emulsion stream, emulsion which has been left in the mixer for 33–38 minutes to allow full foaming before being pumped to the shear pump and packaged, has a packaged density of 1.26–1.34 g./cc. Emulsion which has been left in the mixer for only 8–12 minutes before pumping to the shear pump (i.e., less than 50% foamed before pumping) and packaged, has a packaged density of 1.08–1.11 g./cc.

This experiment shows that the desired low density attainable with a given amount of a given gas-generating material (1.08–1.11 g./cc. in this case) is not achieved after the emulsion has been pumped and mixed in the fully foamed condition. This experiment also shows the criticality of injecting the gas-generating material into a stream of the emulsion rather than in a large volume vessel containing the emulsion. When the emulsion is formed in large batches in a large-volume mixer, although emulsion which has been left in the mixer for only 8–12 minutes will have a suitably low density in this system, much of the emulsion will be retained in the mixer for longer periods owing to the time required to pump out large volumes, the need to reduce pumping rates to accommodate packaging speeds, mixer shutdown, etc. As a result, the packaged densities will vary because of the variable degree of foaming, and the densities will be higher than required if a high degree of foaming has preceded the pumping and mixing operations.

Injection of the gas-generating material into the emulsion stream either upstream or downstream of the pump which delivers the stream to a second mixer or to the packaging receivers is feasible in the present process, injection downstream of the pump being preferred when the gas-generating material reacts relatively rapidly, e.g., in the permanganate/peroxide system, as this assures a minimum degree of foaming of the emulsion being worked.

I claim:

1. In a method of chemically foaming an emulsion comprised of oxidizing salt, carbonaceous fuel, water and emulsifier to form a blasting agent wherein a gas-generating material is injected into the emulsion and the injected emulsion is subjected to work, said gas-generating material reacting with gas evolution so as to foam said emulsion and thereby decrease the density thereof, the improvement comprising injecting the gas-generating material into a stream of the emulsion, subjecting the injected stream to work only before more than about 50 percent of the total density decrease that is attainable by the full foaming of said emulsion has occurred, and delivering the injected stream into packaging receivers where the remainder of the density decrease takes place, whereby a substantially uniform lowered density is achieved from one receiver to another.

2. A method of claim 1 wherein the injected stream is subjected to work only before more than about 25 percent of the total density decrease that is attainable by the full foaming of said emulsion has occurred.

3. A method of claim 1 wherein work is performed on the injected stream by a pump.

4. A method of claim 3 wherein the emulsion stream is pumped from a mixing apparatus into said packaging receiver(s).

5. A method of claim 4 wherein the emulsion stream is mixed and pumped continuously.

6. A method of claim 1 wherein work is performed on the injected stream by a mixing apparatus.

7. A method of claim 6 wherein the emulsion is formed in a first mixing apparatus and a stream thereof is pumped to a second mixing apparatus for incorporating said gas-generating material, and thence into said packaging receivers(s).

8. A method of claim 7 wherein said gas-generating material is injected into the stream prior to or during the stream's entry into said second mixing apparatus.

9. A method of claim 7 wherein said emulsion is formed continuously in said first mixing apparatus, and the emulsion stream is pumped continuously therefrom.

10. A method of claim 7 wherein the viscosity of the emulsion stream exiting from said second mixing apparatus is at least about 10 times higher than that of the stream entering said second mixing apparatus.

11. A method of claim 7 wherein said gas generating material is N,N'dinitrosopentamethylenetetramine.

12. A method of claim 7 wherein said gas-generating material comprises two components.

13. A method of claim 12 wherein said two components are hydrogen peroxide and a compound that oxidizes or catalyzes the decomposition of hydrogen peroxide.

14. A method of claim 13 wherein said two components are hydrogen peroxide and a source of manganous or cupric ion.

15. A method of claim 14 wherein said source of manganous ion is permanganate.

16. A method of claim 12 wherein one of the components of said gas-generating material is injected into the emulsion stream, and the other component is present in said first mixing apparatus.

17. A method of claim 12 wherein both components of said gas-generating material are injected into the emulsion stream.

18. A method of claim 17 wherein said components are combined and injected into the emulsion stream together.

19. A method of forming a sensitized emulsion blasting agent comprising:

a. mixing inorganic oxidizing salt, carbonaceous fuel, water, and emulsifier in a first shear-type mixing apparatus to form a coarse emulsion;

b. pumping a stream of said coarse emulsion from said first shear-type mixing apparatus for converting the coarse emulsion to a fine emulsion, and into one or more packaging receivers; and c. injecting a gas-generating material into the emulsion stream, said gas-generating material reacting with gas evolution so as to foam said emulsion and thereby decrease the density thereof, work being performed on the injected stream by said pump and said second shear-type mixing apparatus only before more than about 50 percent of the total density decrease that is attainable by the full foaming of said emulsion has occurred, the remainder of the density decrease of the emulsion occurring in the packaging receivers, whereby a substantially uniform lowered density is achieved from one receiver to another.

20. A method of claim 19 wherein said gas-generating material is injected into the emulsion stream downstream of the pump which delivers it from said first shear-type mixing apparatus.

21. A method of claim 20 wherein said gas-generating material is injected into the stream of coarse emulsion immediately prior to the stream's entry into said second mixing apparatus.

22. A method of claim 19 wherein the viscosity of the emulsion stream exiting from said second mixing apparatus is at least about 10 times higher than that of the stream entering said second mixing apparatus.

23. A method of claim 19 wherein said gas-generating material comprises two components.

24. A method of claim 23 wherein one of the components of said gas-generating material is injected into the emulsion stream, and the other is present in said first mixing apparatus.

25. A method of claim 23 wherein both components of said gas-generating material are injected into the emulsion stream.

* * * * *